US007275463B2

(12) United States Patent
Sipos et al.

(10) Patent No.: US 7,275,463 B2
(45) Date of Patent: Oct. 2, 2007

(54) TONG WITH A CONTINUOUS COMPOSITE BELT AND METHODS FOR MAKING AND USING SAME

(75) Inventors: David L. Sipos, Lafayette, LA (US); Patrick Johnson, Clifton, TX (US); Donald E. Mosing, Lafayette, LA (US)

(73) Assignee: Orbix Corporation, Clifton, TX (US)

( * ) Notice: Subject to any disclaimer, the term of this patent is extended or adjusted under 35 U.S.C. 154(b) by 0 days.

(21) Appl. No.: 10/366,677

(22) Filed: Feb. 13, 2003

(65) Prior Publication Data

US 2003/0177874 A1 Sep. 25, 2003

Related U.S. Application Data

(60) Provisional application No. 60/358,046, filed on Feb. 19, 2002.

(51) Int. Cl.
*B25B 13/52* (2006.01)

(52) U.S. Cl. ..... 81/64; 81/57.17; 81/57.2; 81/57.33

(58) Field of Classification Search ..... 81/64–65.4, 81/66–70, 3.43, 95, 57.15, 57.17, 57.2, 57.33
See application file for complete search history.

(56) References Cited

U.S. PATENT DOCUMENTS

| | | | | | |
|---|---|---|---|---|---|
| 218,285 | A | * | 8/1879 | Leaycraft | 81/64 |
| 1,123,598 | A | * | 1/1915 | Rutledge | 81/69 |
| 1,925,970 | A | | 9/1933 | Pennington | |
| 2,004,830 | A | * | 6/1935 | Rector | 81/64 |
| 2,523,159 | A | | 9/1950 | Spinner | |
| 2,780,951 | A | * | 2/1957 | Georges | 81/64 |
| 3,013,455 | A | * | 12/1961 | Bettys | 81/69 |
| 3,838,615 | A | * | 10/1974 | McFarland et al. | 81/64 |
| 3,892,140 | A | | 7/1975 | Fox et al. | |
| 4,079,640 | A | | 3/1978 | Golden | |
| 4,099,429 | A | | 7/1978 | Hauk | |
| 4,200,010 | A | | 4/1980 | Hewitt | |
| 4,212,212 | A | | 7/1980 | Chandler et al. | |
| 4,212,577 | A | | 7/1980 | Swanson | |
| 4,347,290 | A | * | 8/1982 | Haemers | 428/625 |
| 4,471,674 | A | | 9/1984 | Doss | |
| 4,512,216 | A | | 4/1985 | Callegari, Sr. et al. | |
| 4,543,858 | A | * | 10/1985 | Luck | 81/64 |
| 4,598,615 | A | * | 7/1986 | Tate | 81/64 |
| 4,604,922 | A | | 8/1986 | Soutsos | |
| 4,683,962 | A | | 8/1987 | True | |
| 4,694,712 | A | | 9/1987 | Doss | |
| 4,718,314 | A | | 1/1988 | Coyle, Sr. et al. | |

(Continued)

*Primary Examiner*—Hadi Shakeri
(74) *Attorney, Agent, or Firm*—Robert W Strozier

(57) ABSTRACT

A manual tong is disclosed which includes a continuous composite continuous belt, a handle assembly, and a jaw assembly, where the continuous composite continuous belt is designed to take the place of the convention linked chains used currently in manual tongs. The continuous composite continuous belt is held in place by a set of pins associated with the handle and jaw assemblies. Replacement of the linked chains with the continuous composite continuous belts improve tong safety, improve ease of use, lower cost, make adjustment easier and make continuous belt replacement easier reducing down time and increasing tong utility (one tong can be used for different pipe diameters with a simply adjustment of the continuous belt or a simple replacement of the continuous belt with a different size continuous belt.

21 Claims, 7 Drawing Sheets

U.S. PATENT DOCUMENTS

| | | | | | |
|---|---|---|---|---|---|
| 4,774,860 | A | | 10/1988 | Hawke | |
| 4,895,056 | A | | 1/1990 | Schulze-Beckinghausen | |
| 4,913,010 | A | * | 4/1990 | Doss | 81/64 |
| 4,987,804 | A | * | 1/1991 | Greenawalt | 81/64 |
| 5,150,638 | A | | 9/1992 | Penisson | |
| 5,390,570 | A | * | 2/1995 | Reisner | 81/64 |
| 5,440,955 | A | * | 8/1995 | Freeland | 81/64 |
| 5,704,258 | A | * | 1/1998 | LaVoie | 81/3.43 |
| 6,089,126 | A | * | 7/2000 | Teeter et al. | 81/64 |
| 6,150,638 | A | * | 11/2000 | Strodtbeck et al. | 81/57.17 |
| 6,520,052 | B1 | * | 2/2003 | Saunders et al. | 81/64 |
| 6,572,505 | B1 | * | 6/2003 | Knutson | 474/260 |

* cited by examiner

TONG WITH A CONTINUOUS COMPOSITE BELT AND METHODS FOR MAKING AND USING SAME

RELATED APPLICATION

This application claims provisional priority of U.S. Provisional Patent Application Ser. No. 60/358,046, filed Feb. 19, 2002.

BACKGROUND OF THE INVENTION

1. Field of the Invention

The present invention relates to a tong including a continuous composite belt and methods for making and using same.

More particularly, the present invention relates to a tong including a handle assembly, a jaw assembly, a hook plate assembly and a continuous composite belt, where the belt is secured to the hook plate and jaw assemblies and methods for making and using the tong to rotate or turn a pipe.

2. Description of the Related Art

Current tongs for use in the oil industry and other related industries use linked chains to wrap around the piping so that the pipe can be broken-down or made up. Although these linked chains are manufactured to high precision and to withstand pressure well in excess of their operating limits. However, when such linked chains fail, the chains can cause metal pieces to be ejected from the chain at relatively high velocity.

Thus, there is a need in the art for a tong apparatus including a continuous composite belt in place of a chain to reduce down time in the event of a tong failure and to reduce the risk of harm to personnel and/or other equipment in the event of tong failure.

SUMMARY OF THE INVENTION

The present invention provides a tong apparatus including a continuous composite belt adapted to act, along with the a jaw, as the pipe engaging part tong, where the word continuous means that the belt is in the form of a loop like a rubber band.

The present invention provides a tong apparatus including a handle, a jaw, and a continuous composite belt.

The present invention provides a tong apparatus including a handle assembly, a jaw assembly, a hook plate assembly and a continuous composite belt.

The present invention provides a tong apparatus including a handle, a jaw, a jaw pin, a continuous composite belt, a top hook plate, a bottom hook plate, a hook pin, hook grip pins and a latch pin.

The present invention provides a tong apparatus including a handle, a jaw, a jaw pin, a continuous composite belt, a top hook plate, a bottom hook plate, a hook pin, hook grip pins, a latch pin and a hanger.

The present invention provides a tong apparatus including a handle, a jaw, a jaw pin, a continuous composite belt, a top hook plate, a bottom hook plate, a hook pin, a hook grip pin, a latch pin, a spring, a hanger, and a bumper.

The present invention provides method for turning a pipe including detaching one end of the belt from a tong apparatus of this invention including a continuous composite belt, wrapping the belt around the pipe, positioning the tong apparatus at a desired position on the pipe, reattaching the end of the belt to the tong, and applying a force to the handle of the tong to turn the pipe.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1:
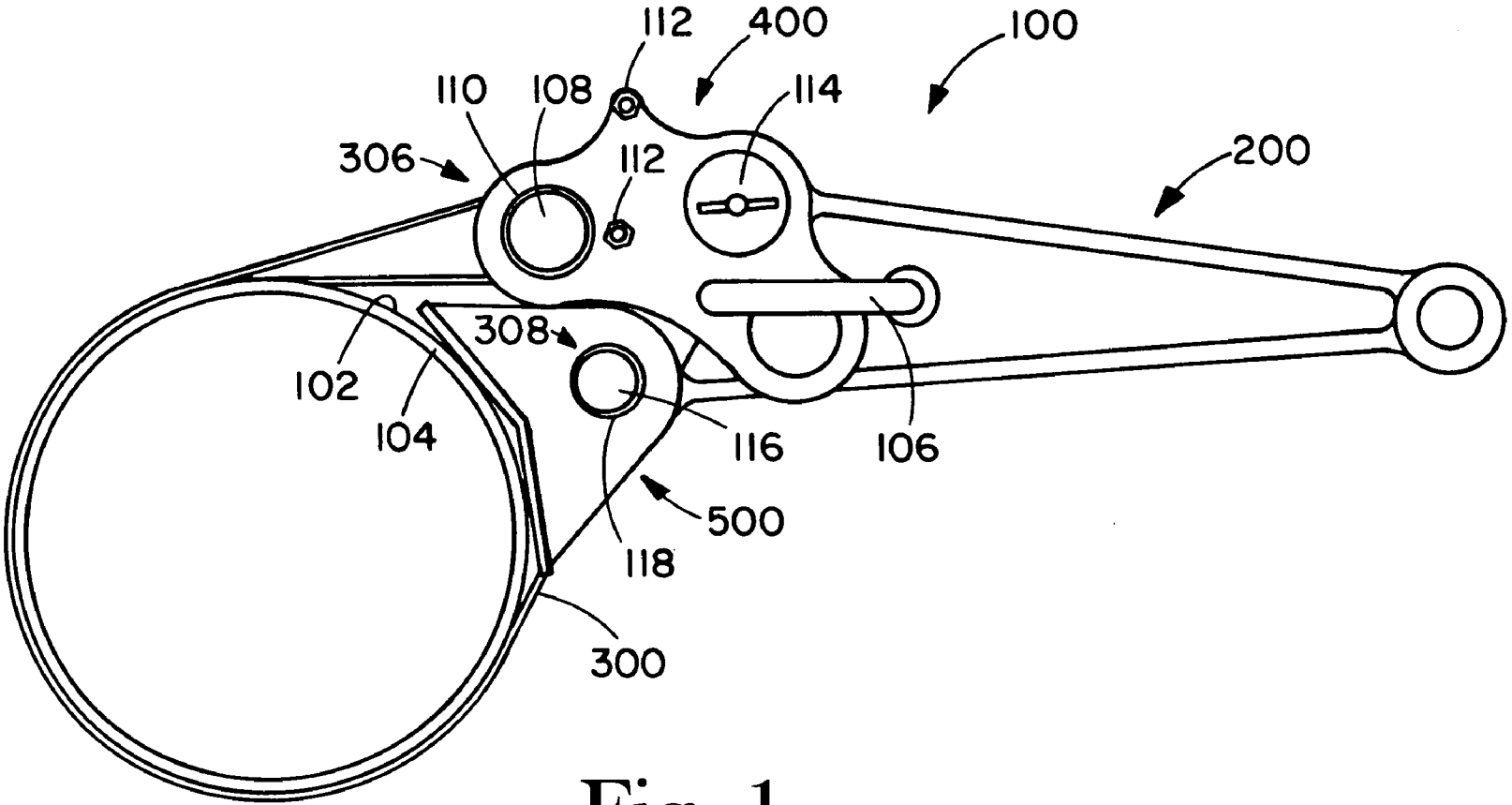
FIG. 1 depicts a top plan view of one preferred embodiment of the tong apparatus of this invention.

The inventors have found that a tong can be constructed using a continuous composite belt instead of a linked chain to engage a pipe, casing or the like to turn the pipe. The inventors have found that the continuous composite belt yields a lighter weight tong with improved safety because catastrophic failure of a linked-chain can result in a risk of injury to workers due for example to flying metal fragments, while failure of the continuous composite belt would reduce or substantially eliminate any worker risk. Moreover, the inventors have found that tongs including continuous composites belts are easier to attach, maintain, and adjust compared to tongs with traditional linked chain engaging members. Furthermore, the inventors have found that tongs including continuous composite belts allow for faster and easier field repair, because when a belt fails, a new belt can be attached quickly by simply removing two pins in the tong.

The tongs of this invention share some structural elements of traditional linked chain tongs. The tongs include a jaw assembly pivotally mounted on, connected to or attached to a handle assembly. The jaw assembly and belt are adapted to engage a pipe allowing the pipe to be rotated or turned. The continuous belt is adapted to engage a portion of the pipe and the jaw is adapted to engage the same portion of the pipe, but opposite the belt. The belt is anchored to the tong at two places using removable pins. Preferably, the belt attaches at one end to the jaw assembly and at the other end to the hook assembly via the pins. Optionally, the belt can be tightened about the pipe. Once the belt is looped about the pipe and reattached to the tong and optionally tightened about the pipe, the tong permits force to be transferred from the handle assembly to the pipe via the belt and jaw resulting in rotation of the pipe.

The continuous composite belts to be used in the tongs of this invention include a polymeric matrix reinforced by longitudinally extending continuous fibers, yarn, woven strings, wires, fiber bundles, wire bundles, fabric, meshes or mixtures or combinations thereof. In the case of continuous fibers, strings, yarn, wires or bundles, they generally run parallel at a desired spacing relative to the width of the continuous belt. Preferably, the spacing is sufficient to allow complete encapsulation of each fiber, wire or bundle in the polymeric matrix. Although continuous fibers, yarns or woven strings are preferred, thin metal wires can also be used or a combination of fibers and metal wires or bundles comprising fibers and wires can be used. In the case of fabric and/or meshes, the fabric preferably has sufficient openings to allow the matrix material to embed the fabric or mesh.

Suitable polymeric matrices for use in the continuous belts of this invention include, without limitation, any type of thermoplastic or thermosetting material such as elastomers, thermoplastic elastomers, epoxy resins, phenolic resins, urethanes, or mixtures or combinations thereof. Generally, the matrices are cured with the fibers, yams, string, wires or bundles embedded in the matrix. The curing can be accomplished by any curing method known in the art depending on the nature of the polymers making up the matrix including, without limitation, radiation curing, heat curing, light curing, or mixture or combinations thereof. The curing can also be enhanced or accelerated by chemical cure system as is well known in the art. The matrices can also include additives such as filler including carboneous fillers such as carbon black or the like, fiber fillers such as chopped fibers including the fibers set forth below for the continuous fibers, and inorganic fillers such as silica, clay, calcium carbonate, zeolites, mordenites, fugacites, or the like or mixtures or combinations thereof. For further details relating to polymeric matrices and/or their cure systems the readers is directed to the following U.S. Pat. Nos.: 3,257,346, 3,517,722, 3,738,948, 3,931,090, 3,933,732, 4,130,519, 4,605,696, 4,633,912, 4,684,421, 5,254,616, 5,091,449, incorporated herein by reference. The matrices can also include anti-degradants such as anti-oxidants, anti-ozonants, or the like, plasticizers, flow enhancers, or the like.

Suitable continuous fibers, yams or woven string for use in this invention include, without limitation, carbon fibers, boron-nitride fibers, polyamide fibers, polyimide fibers, glass fibers, or mixtures or combinations thereof. The fibers can be also coated with a bonding material and/or chemically and/or physically treated to increase adhesion between the matrix and the fiber. Such treatments can also include physical treatments such as ion bombardments or ion implantations. Although many of these treatments may increase adhesion and/or bonding interactions between the fiber and the matrix, these treatments tend to reduce the tensile strength of the fibers. Therefore, the treatments are used only when the treated fiber has adequate tensile strength for the intended application.

Suitable metal wires include, without limitation, iron alloy wires or other similar metal wires having high tensile strengths. Generally, iron alloy wires are coated with a micro bonding layer including copper, zinc, cobalt, brass, bronze, nickel, or the like or mixture or combinations thereof. These coating improve the adhesion and/or bonding between the metal surface and polymeric matrix.

Preferred belts are manufactured by Roblon A/S and sold by Tasmanian Tool Company, Inc. of Lafayette, La.

Referring now to FIG. 1, one preferred embodiment of a tong apparatus, generally 100, of this invention is shown to include a handle assembly 200, a continuous composite belt 300, a hook plate assembly 400 and a jaw assembly 500, where the tong 100 is adapted to engage a surface 102 of a pipe 104 so that the pipe 104 can be rotated or turned. The apparatus 100 also includes a hanger 106 adapted to allow the apparatus 100 to be hung when attached to vertically oriented pipe. The apparatus 100 also includes a belt pin 108, which can be held in place with a retaining ring 110. The apparatus 100 also includes alignment and spacing bolts 112. The apparatus 100 also includes a handle pin 114 (shown as a latch pin here), where the handle pin 114 is adapted to pivotally mount the hook plate assembly 400 on the handle assembly 200. The apparatus 100 also includes a jaw pin 116, which can be held in place with a retaining ring 118 and adapted to pivotally mount the jaw assembly 500 on the handle assembly 200.

Figure 2B:
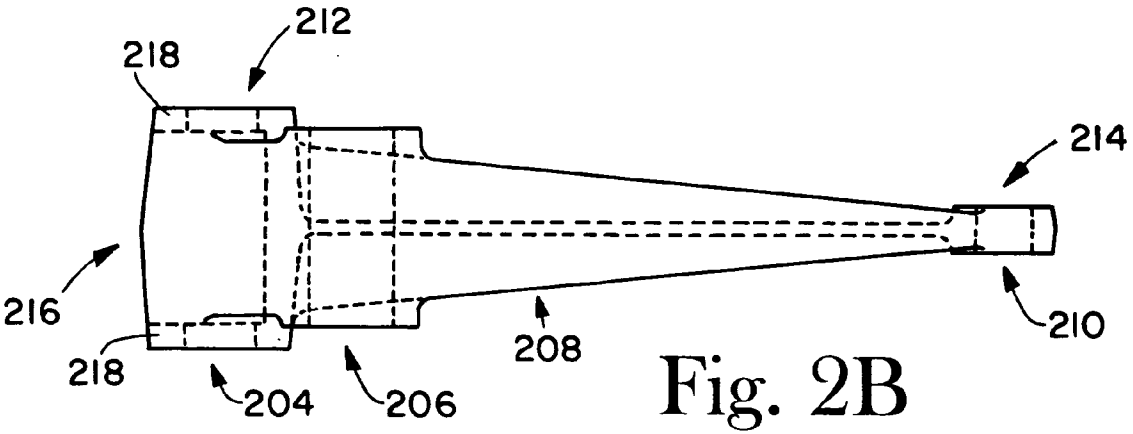
FIG. 2B depicts a side view of the handle assembly of FIG. 2A.
Figure 2A:
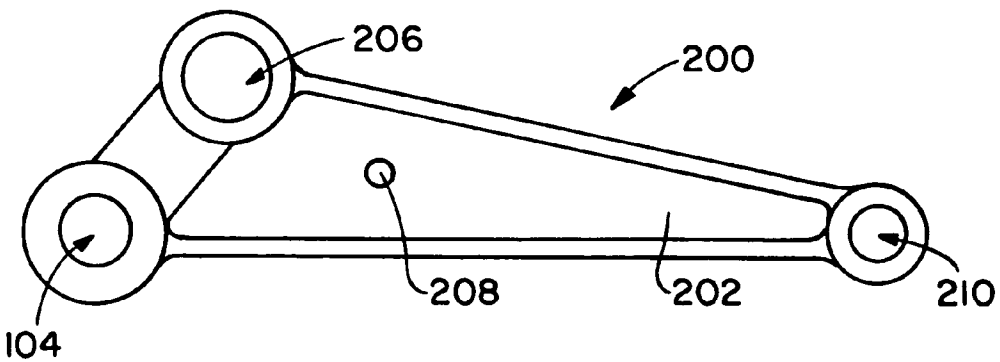
FIG. 2A depicts a top view of a preferred embodiment of a handle assembly of the tong apparatus of FIG. 1.
Figure 2C:
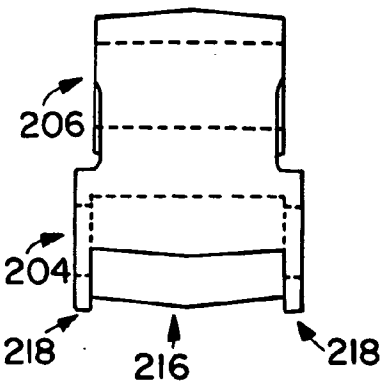
FIG. 2C depicts a front view of the handle assembly of FIG. 2A.

Referring now to FIGS. 2A-C, the handle assembly 200 includes a handle 202, a jaw pin aperture 204, a hook plate assembly pin aperture 206 and a hanger aperture 208. The handle 202 is adapted to transmit rotational force to the pipe 104 via the belt 300 and the jaw assembly 500. The jaw pin aperture 204 is adapted to receive the jaw pin 116 and to allow the jaw assembly 500 to be pivotally mounted on the handle 202. The hook plate assembly pin aperture 206 is adapted to receive the hook pin 114 and to allow the hook plate assembly 400 to be pivotally mounted to the handle 202. The hanger aperture 208 is adapted to receive a hanger 106. The handle assembly 200 optionally includes an end aperture 210 for hanging the tong 100, when not in use. Looking at FIG. 2A, the handle assembly 200 is of a general triangular shape with each aperture 206, 208 and 210 at the vertices of the triangle. Looking at FIGS. 2B&C, the handle 202 includes a rectangular-shaped head 212 which tapers to a rectangular tail 214. The rectangular head 212 includes a jaw receiving cavity 216 and jaw pin protrusions 218. The cavity 216 is designed to allow the jaw assembly 500 to pivot when mounted on the handle assembly 200.

Referring now to FIG. 1 and FIGS. 3A-D, two illustrative examples of belts, generally 300, are shown as comprising a high tensile strength fiber reinforced polymeric matrix 302 including a plurality of spaced apart, parallel and longitudinally extending continuous fiber bundles 304 encased or embedded in the polymeric matrix 302. Looking at FIGS. 3A&B, one embodiment of the belt 300 is shown to include two smooth surfaces 306 and 308. Looking at FIGS. 3C&D, another preferred embodiment of the belt 300 is shown to further include laterally extending teeth, ribs or ridges 310 and valleys or grooves 312 on the surface 306 which becomes the pipe engaging surface.

Referring now to FIGS. 3E-I, several illustrative examples of ribbed belts 300 are shown. Looking at FIG. 3E, the ribs 310 and the valleys 312 are substantially rectangular (where rectangular includes a square) in shape. Looking at FIG. 3F, the ribs 310 and the valleys 312 are shown as substantially trapezoidal in shape. Looking at FIG. 3G, the ribs 310 are substantially dome shaped and the valleys 312 are substantially rounded rectangles in shape. Looking at FIG. 3H, the ribs 310 and the valleys 312 are non-symmetric trapezoids in shape, where each trapezoid have a vertical edge 314 and a slanting edge 316 giving rise to a right-hand oriented rib pattern 318. Looking at FIG. 3I, the ribs 310 and the valleys 312 are non-symmetric trapezoids in shape, where each trapezoid have a vertical edge 320 and a slanting edge 322 giving rise to a left-hand oriented rib pattern 324.

Figure 3A:
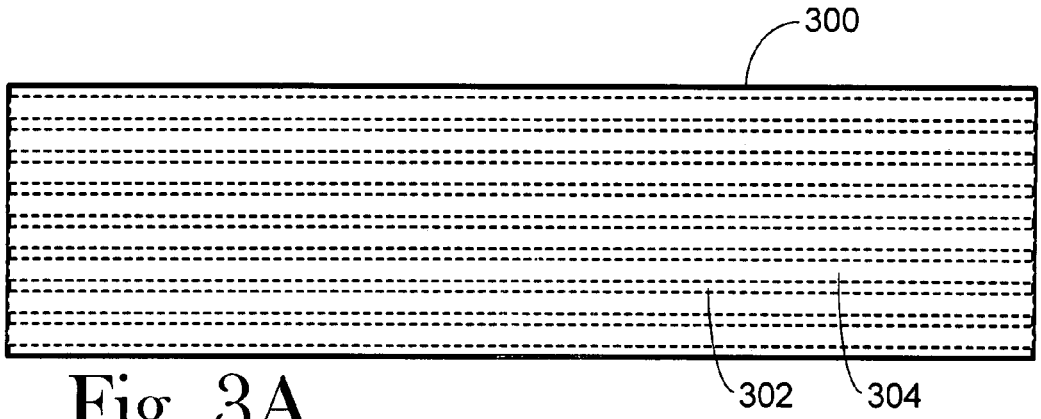
FIGS. 3A-D depict a top and side views of belt constructions of this invention.
Figure 3B:
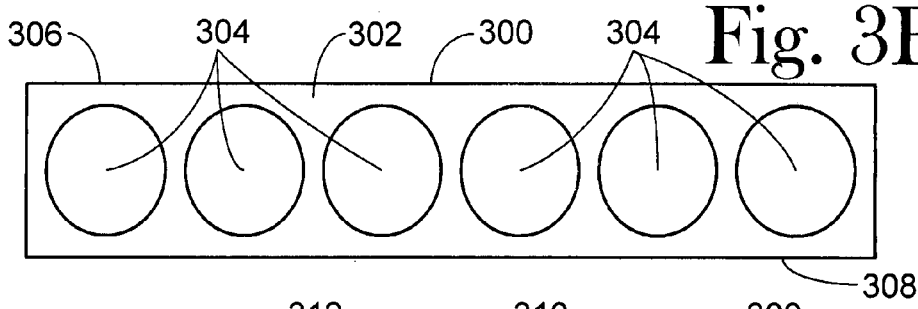
Figure 3C:
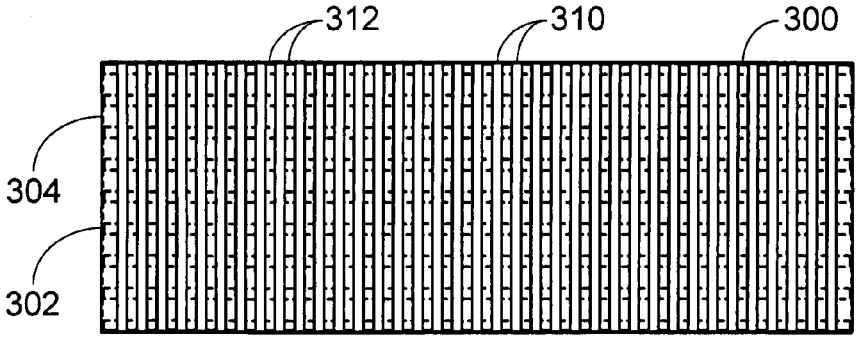
Figure 3D:
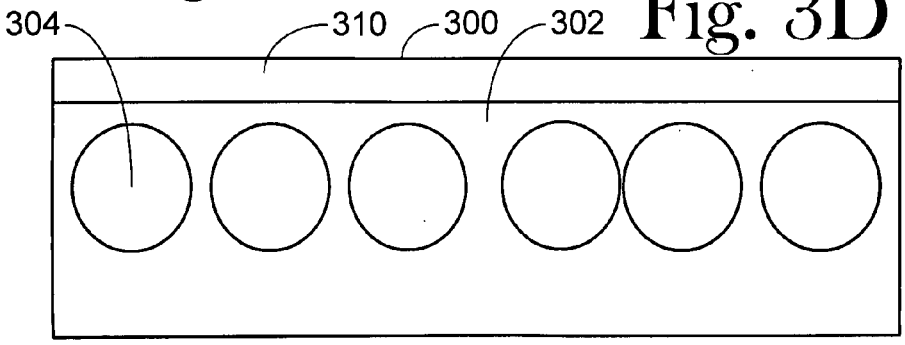
Figure 3E:
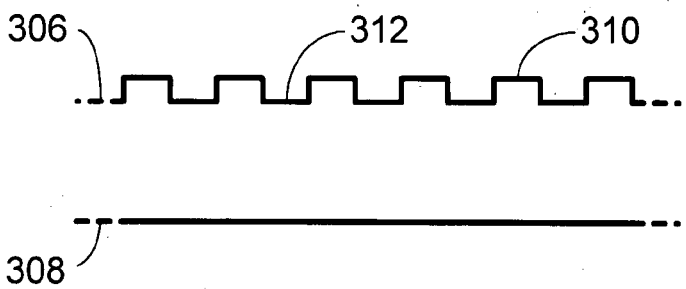
FIGS. 3E-I depict views of surfaces of the belts of FIGS. 3A-D.
Figure 3F:
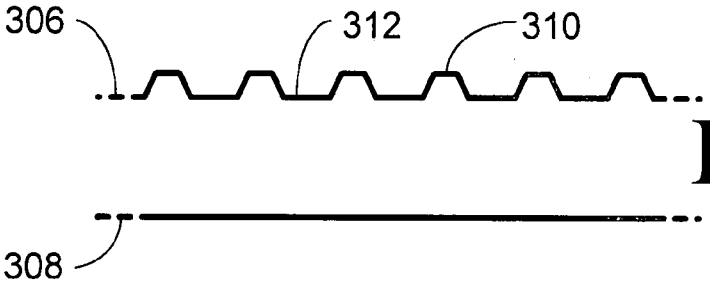
Figure 3G:
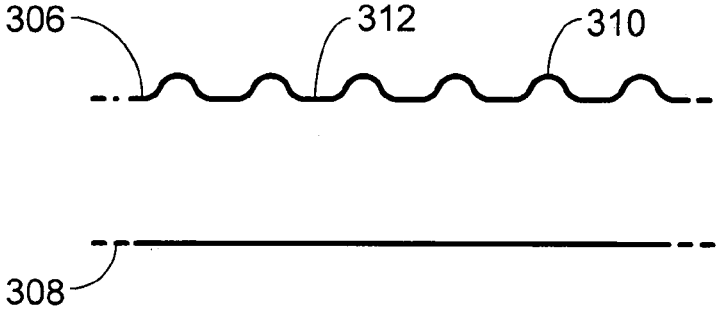
Figure 3H:
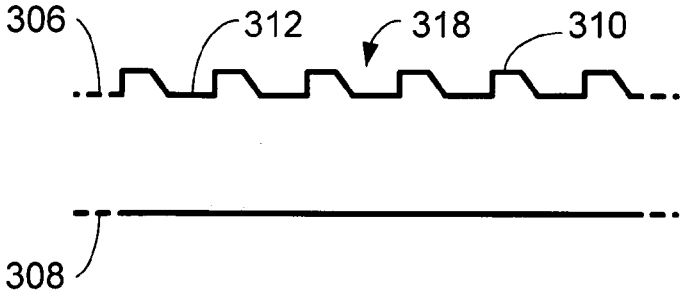
Figure 3I:
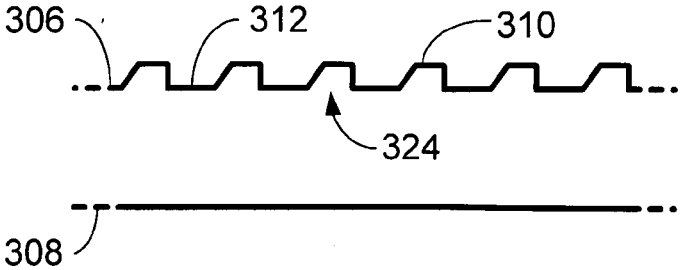
Figure 3J:
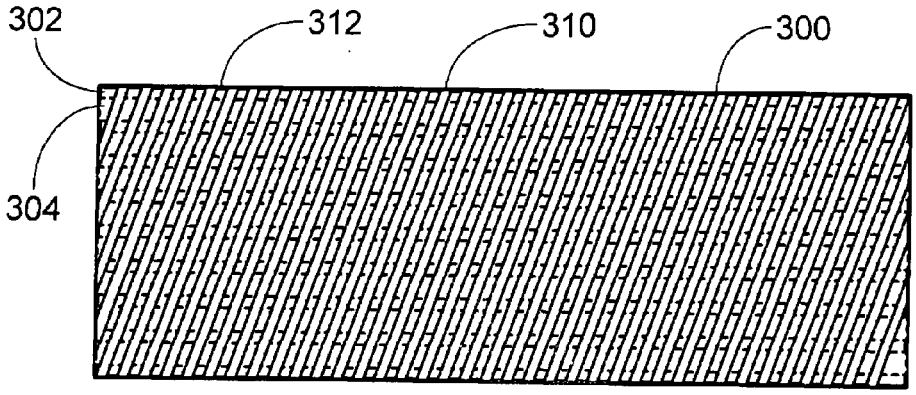
FIG. 3J depicts a top view of a belt construction having angled ribs and valleys.
Figure 3K:
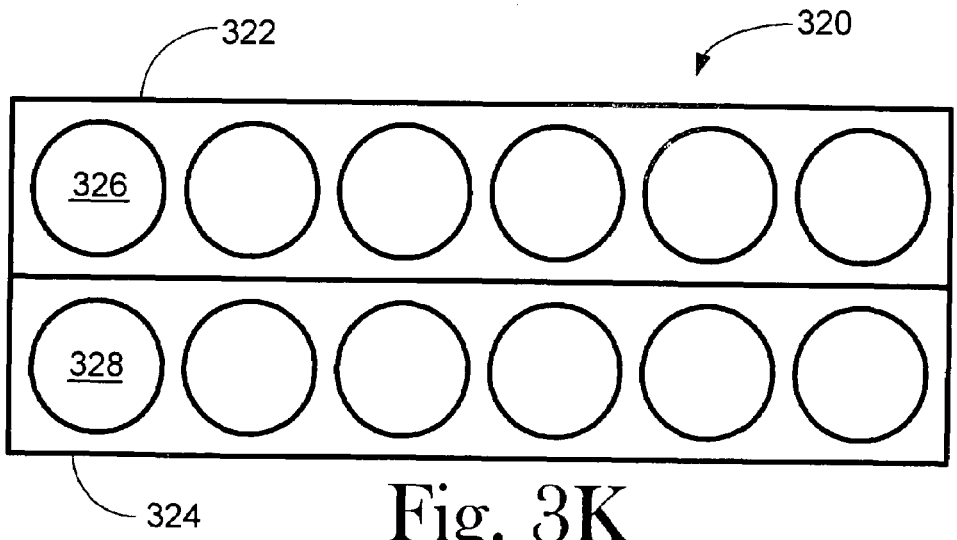
FIGS. 3K&L depict sides views of preferred embodiments of two ply belts.

Of course, one of ordinary skill in the art can clearly recognize that other rib and valley geometrical shapes can be constructed and that the belts could include mixtures or combinations thereof. In fact, the ribs and valleys do not have to extent longitudinally, but can extend at an angle as shown in FIG. 3J, where the belt 300 has angled ribs 310 and valleys 312.

Figure 3L:
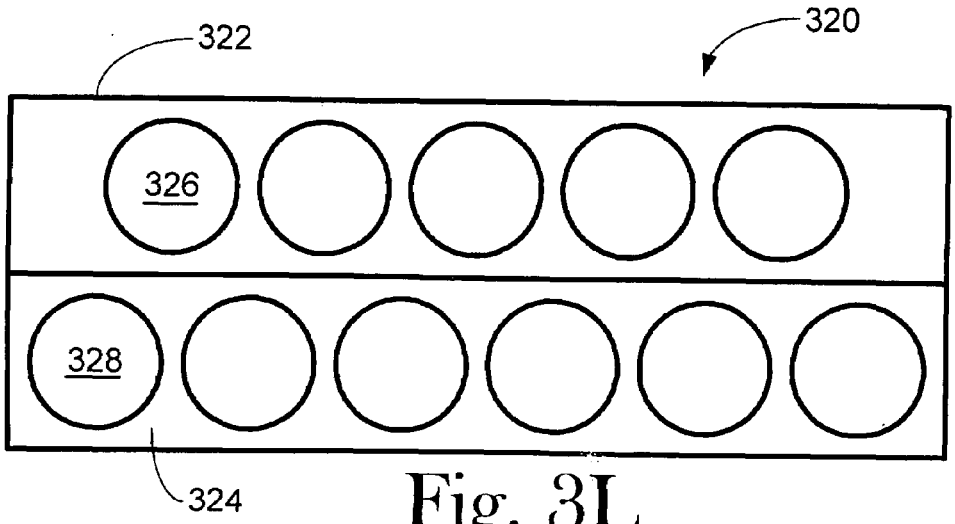
FIGS. 3M&N depict a top view and side view, respectively, of a preferred embodiment multi-ply belt.
Figure 3M:
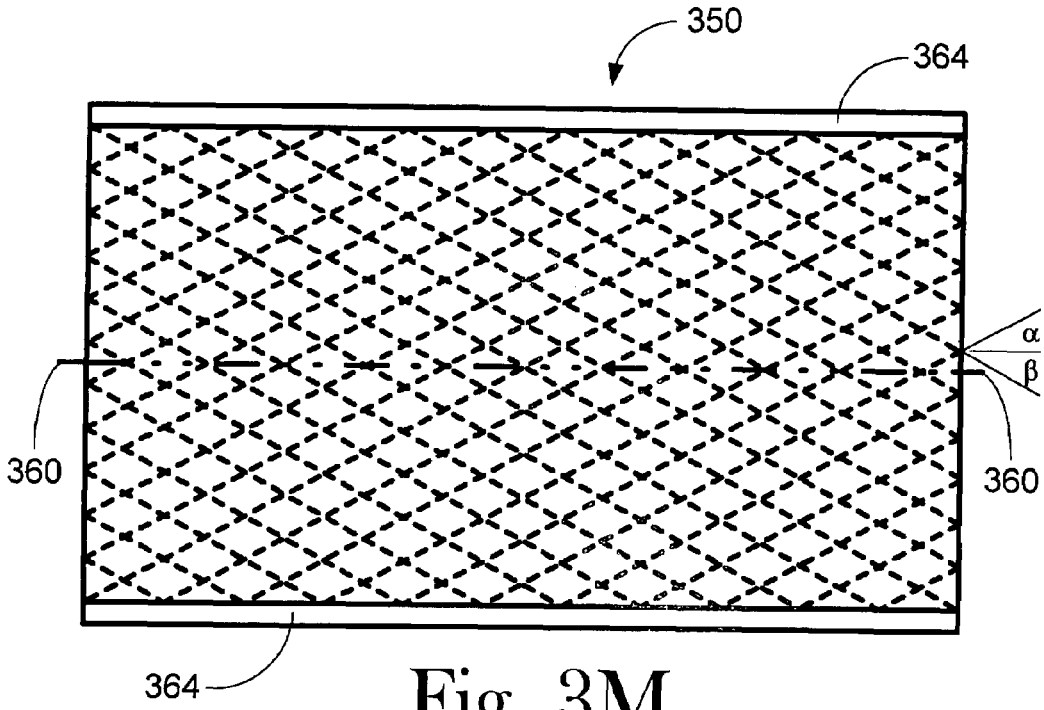
Figure 3N:
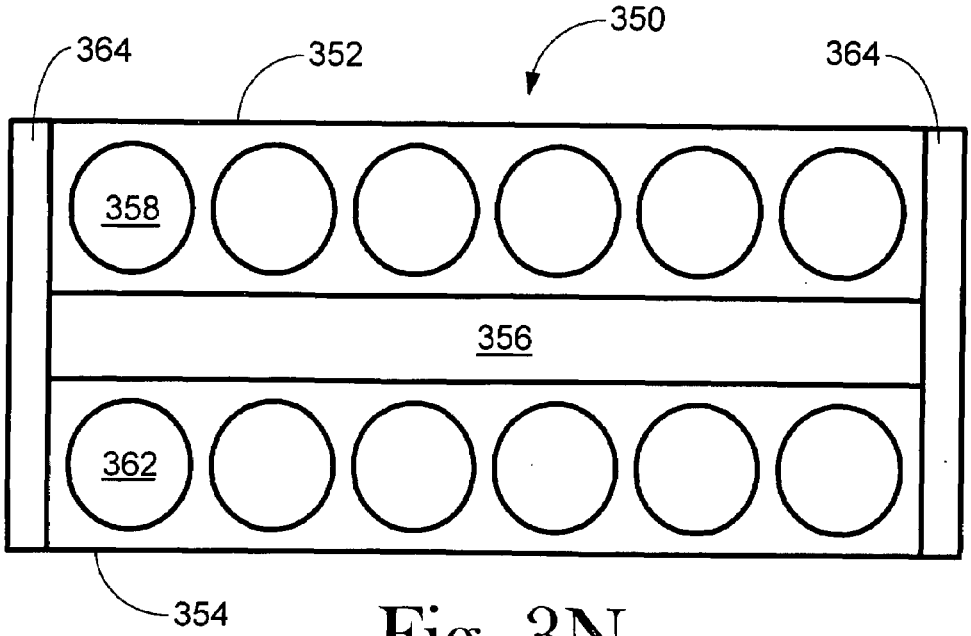
Figure 5B:
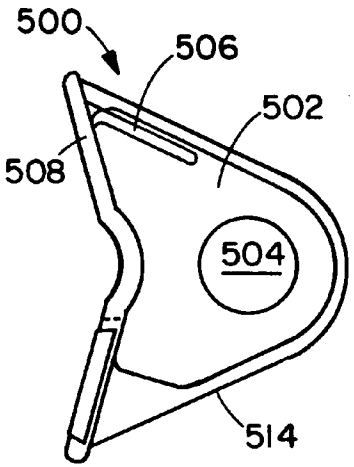
FIG. 5B depicts a side view of the jaw assembly of FIG. 5A.

Alternatively, the belt can include more than one ply of reinforcing fibers. In one preferred embodiment of a multi-ply constructions, two fiber reinforced plies are simply staked one on top of the other. Referring now to FIG. 3L, a preferred embodiment of a two-ply belt 320 is shown to include a first reinforced ply 322 and a second reinforced ply 324, where the fibers or fiber bundles 326 and 328 of the plies 322 and 324, respectively, are aligned one on top of the other. Referring now to FIG. 3B, another preferred embodiment of a two-ply belt 320 is shown to include a first reinforced ply 322 and a second reinforced ply 324, where the fibers or fiber bundles 326 and 328 of the plies 322 and 324, respectively, are offset. Referring now to FIGS. 5C&D, a preferred embodiment multi-ply belt 350 is shown to include a first reinforced ply 352 and a second reinforced ply 354 separated by a matrix ply 356. In the first ply 352, fibers or fiber bundles 358 are biased and extend at a first angle $\alpha$ relative to a central longitudinal axis 360, while in the second ply 354, fibers or fiber bundles 362 are also biased and extend at a second angle $\beta$, where $\beta$ preferably is equal to $-\alpha$ as shown. Because the reinforcing plies are cut on a bias, the belt 350 will also preferably include longitudinally extending end caps 364 comprising the polymer matrix to protect the cut ends of the fibers or fiber bundles. Of course, the number of plies can be increased limited only to thickness and weight considerations.

Figure 4B:
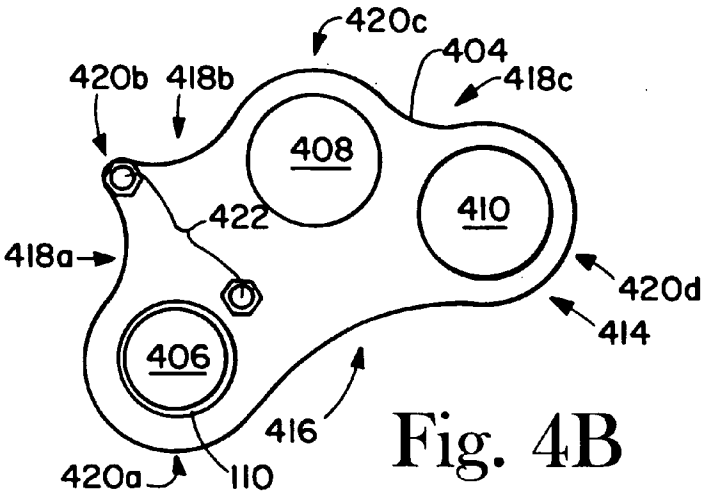
FIG. 4B depicts a top view of a bottom hook plate of FIG. 1.
Figure 4A:
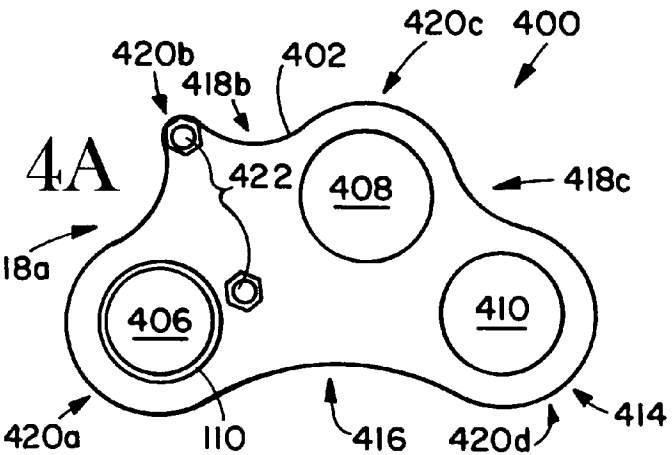
FIG. 4A depicts a top view of a top hook plate of FIG. 1.

Referring now to FIG. 1 and FIGS. 4A&B, the hook plate assembly 400 includes a top plate 402 and a bottom plate 404. Each plate 402 and 404 includes a belt pin aperture 406 with retaining ring 110, a handle pin aperture 408, and an auxiliary aperture 410. The auxiliary aperture 410 is used to adjust the tong 100 by moving the hook plate assembly 400 so that the auxiliary aperture 410 aligns with the hook plate assembly pin aperture 206 of the handle assembly 200. The belt pin aperture 406 is adapted to receive and retain the belt pin 108 by retaining ring 110. The handle pin aperture 408 is adapted to receive and retain the handle pin 114, which is a latch pin. The auxiliary pin aperture 410 is adapted to facilitate the use of the tong 100 with a coupling in lieu of the pipe body. The pin aperture 410 can also include a retaining ring (not shown). The embodiment of FIG. 1 shows the belt pin 108 to have a retaining ring 110, while the handle pin 114 is a latch pin. In another preferred embodiment, the belt pin 108 is a latch pin and the handle pin 114 has a retaining ring. In yet, other preferred embodiments, both the belt pin 108 and the handle pin 114 include retaining rings or both are latch pins.

The belt retaining pin 108 is adapted to be inserted through the first end 306 of the belt 300 (see FIG. 1) so that the belt 300 is positioned between the two plates 402 and 404. Each plate 402 and 404 is in the form of a complex curvilinear shape 414 having a jaw engaging concave region 416, three other concave regions 418*a-c* and four convex regions 420*a-d*. Of course, one of ordinary skill in the art should recognize that the exact shape of the hook plates 402 and 404 can be of any shape. The hook plates 402 and 404 also include two alignment apertures 422 adapted to receive the alignment and spacing bolts 112.

Figure 5A:
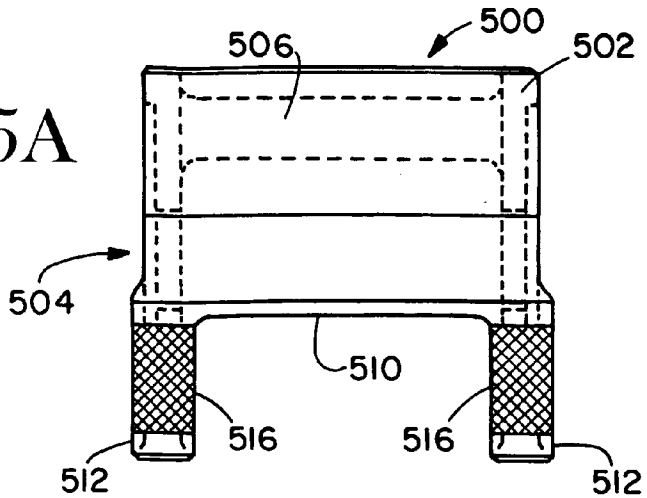
FIG. 5A depicts a front view of the jaw assembly of FIG. 1.

Referring now to FIGS. 5A&B, the jaw assembly 500 includes a body 502 having a jaw pin aperture 504 adapted to receive the jaw pin 116. The jaw pin 116 is adapted to be inserted through the jaw aperture 504 and through the handle assembly 200 to pivotally mount the jaw assembly 500 on the handle assembly 200 and retain the other end 308 of the belt 300 (see FIG. 1). The jaw assembly 500 also includes a reinforcing cross member or web 506, a front flange 508, a rear flange 510, sides flange 512 and a side plate 514. The jaw assembly 500 also includes toothed pipe engaging members 516 situated on side flanges 512.

One of ordinary skill in the art should recognize that other designs of a handle assembly, a jaw assembly and a continuous composite belt can be constructed to accomplish the same goal of this invention, which is a tong including a continuous composite belt to engage and turn the pipe instead of a linked metal chain or other metal chain like device. The continuous composite belt constructed of a fiber or wire reinforced polymer matrix does not fail in a potentially dangerous fashion as is the case for metal linked pipe engaging devices associated with a conventional tong.

When using the tong 100 of FIG. 1, the belt end 306 is taken off by removing one of the hook plates 402 or 404. The belt 300 is then wrapped around the pipe 104. The belt end 306 is then slipped back over the belt pin 108 and the hook plate 402 or 404 reset and the pins latched or retained in place. The handle 202 can then be used to impart a torque to the pipe 104 via the belt.

All references cited herein are incorporated by reference. While this invention has been described fully and completely, it should be understood that the invention may be practiced otherwise than as specifically described. Although the invention has been disclosed with reference to its preferred embodiments, from reading this description those of skill in the art may appreciate changes and modification that may be made which do not depart from the scope and spirit of the invention as described above.

We claim:

1. A manual tong for use in breaking-down or making-up pipe or casing comprising:

a jaw assembly pivotally mounted on a handle assembly by a first pin;

a hanger coupled with the handle assembly;

a hook plate assembly pivotally mounted on the handle assembly by a handle pin, the hook plate assembly further including an aperture for receiving a second pin; and a composite belt comprising a reinforced polymeric matrix forming a continuous endless loop having no ends secured by the first pin to the jaw assembly and by the second pin to the hook plate assembly, where the belt extends from the hook plate assembly to the jaw assembly and where the belt and jaw assembly are adapted to engage a pipe allowing the pipe to be rotated or turned.

2. The tong of claim 1, wherein the reinforced polymeric matrix embeds or encases continuous fibers, yarn, woven strings, wires, bundles, fabric, meshes or mixtures or combinations thereof.

3. The tong of claim 2, wherein the bundles comprise a plurality of continuous fibers, wires or mixtures or combinations thereof.

4. The tong of claim 2, wherein the fibers are selected from the group consisting of carbon fibers, boron-nitride fibers, polyamide fibers, polyimide fibers, glass fibers, or mixtures or combinations thereof.

5. The tong of claim 2, wherein the wires are selected from the group consisting of iron alloy wires having high tensile strengths.

6. The tong of claim 5, wherein the wires includes a bonding layer adapted to improve adhesion between the metal surface and the polymer matrix.

7. The tong of claim 6, wherein the bond layer is selected from the group consisting of copper, zinc, cobalt, brass, bronze, nickel, or mixtures or combinations thereof.

8. The tong of claim 2, wherein the matrix is selected from the group consisting of plastic, thermoplastic, thermosetting material or mixtures or combinations thereof.

9. The tong of claim 2, wherein the matrix is selected from the group consisting of elastomers, thermoplastic elastomers, epoxy resins, phenolic resins, urethanes, or mixtures or combinations.

10. The tong of claim 2, wherein the belt includes ribs and valleys on a pipe engaging surface, where the ribs and valleys are adapted to form channels for liquid and/or semi-solid contaminants to be squeezed away from the pipe surface.

11. A manual tong for use in breaking-down or making-up pipe or casing comprising:

a hanger coupled with the handle assembly;

a jaw assembly pivotally mounted on the head of the handle assembly at a jaw mount position and including a first belt pin;

a hook plate assembly pivotally mounted on the head of the handle assembly at a hook plate mount position by a handle pin and including an aperture for receiving a second belt pin; and a composite belt comprising reinforced polymeric matrix forming a continuous endless loop having no ends and adapted to be retained by the first and second belt pins so that the pins are disposed inside the loop, where the belt and jaw assembly are adapted to engage a pipe so that two thicknesses of the belt engage a portion of an outer surface of the pipe from the jaw assembly to the hook plate assembly allowing the pipe to be rotated or turned by applying a force to the handle a handle assembly including a handle and a head;

12. The tong of claim 11, wherein the reinforced polymeric matrix embeds or encases continuous fibers, yarn, woven strings, wires, bundles, fabric, meshes or mixtures or combinations thereof.

13. The tong of claim 12, wherein the bundles comprise a plurality of continuous fibers, wires or mixtures or combinations thereof.

14. The tong of claim 12, wherein the fibers are selected from the group consisting of carbon fibers, boron-nitride fibers, polyamide fibers, polyimide fibers, glass fibers, or mixtures or combinations thereof.

15. The tong of claim 12, wherein the wires are selected from the group consisting of iron alloy wires having high tensile strengths.

16. The tong of claim 15, wherein the wires includes a bonding layer adapted to improve adhesion between the metal surface and the polymer matrix.

17. The tong of claim 16, wherein the bond layer is selected from the group consisting of copper, zinc, cobalt, brass, bronze, nickel, or mixtures or combinations thereof.

18. The tong of claim 12, wherein the matrix is selected from the group consisting of plastic, thermoplastic, thermosetting material or mixtures or combinations thereof.

19. The tong of claim 12, wherein the matrix is selected from the group consisting of elastomers, thermoplastic elastomers, epoxy resins, phenolic resins, urethanes, or mixtures or combinations.

20. The tong of claim 12, wherein the belt includes ribs and valleys on a pipe engaging surface, where the ribs and valleys are adapted to form channels for liquid and/or semi-solid contaminants to be squeezed away from the pipe surface.

21. A method for turning a pipe during break-down or make-up comprising the steps of:

positioning a tong adjacent a pipe, where the tong comprises a jaw assembly pivotally mounted on a handle assembly by a first belt pin, a hanger coupled with the handle assembly, a hook plate assembly pivotally mounted on the handle assembly by a handle pin, the hook plate assembly further including an aperture for receiving a second belt pin, and a composite belt comprising a reinforced polymeric matrix forming a continuous endless loop having no ends;

attaching the belt to the first belt pin of the jaw assembly and to the second belt pin of the hook plate so that the pins are disposed inside the loop and two thicknesses of the belt extends from the hook plate assembly to the jaw assembly around a portion of an outer surface of the pipe and the belt, and jaw assembly engage the pipe; tightening the belt and the jaw assembly against the pipe; and applying torque to the handle to rotate or turn the pipe.

* * * * *